United States Patent [19]

Wanatowicz

[11] Patent Number: 4,922,665

[45] Date of Patent: May 8, 1990

[54] WET SANDER

[76] Inventor: Andrew Wanatowicz, 730 Broadway, Redwood City, Calif. 94063

[21] Appl. No.: 277,877

[22] Filed: Nov. 30, 1988

[51] Int. Cl.[5] ..... B24D 11/00; A47L 13/12

[52] U.S. Cl. ..... 51/392; 51/267; 401/27; 401/137

[58] Field of Search ..... 51/266, 267, 358, 360, 51/361, 382, 388, 322, 206 R, 206 P, 207, 209 R, 209 L, 170 T, 170 TL, 170 MT, 170 RL, 391, 392, 393, 390; 134/68; 401/137, 27, 19, 25, 26; 15/250.01, 250.02

[56] References Cited

U.S. PATENT DOCUMENTS

| | | | |
|---|---|---|---|
| 539,313 | 5/1895 | Thierry et al. | 401/27 X |
| 1,320,299 | 10/1919 | Wilson | 51/392 X |
| 2,112,593 | 1/1937 | Campbell | 51/370 |
| 2,492,602 | 12/1949 | Stenberg et al. | 51/137 |
| 2,922,177 | 1/1960 | Hudson | 15/133 |
| 3,089,294 | 5/1963 | Cowley | 51/186 |
| 3,282,263 | 7/1963 | Christensen | 51/206 R |
| 4,102,084 | 7/1978 | Bloomquist | 51/170 MT |
| 4,175,359 | 11/1979 | Teague, Jr. et al. | 51/170 MT |
| 4,221,084 | 9/1980 | Frantzen | 51/392 |
| 4,320,601 | 3/1982 | Haney | 51/391 |
| 4,484,419 | 11/1984 | Freerks | 51/391 |
| 4,523,411 | 6/1985 | Freerks | 51/170 MT |

FOREIGN PATENT DOCUMENTS

| | | | |
|---|---|---|---|
| 273704 | 4/1930 | Italy | 15/250.01 |

*Primary Examiner*—D. S. Meislin
*Assistant Examiner*—Bruce Watson
*Attorney, Agent, or Firm*—Limbach, Limbach & Sutton

[57] ABSTRACT

The invention provides a manually operable wet sander which uses standard strips or rolls of sandpaper. The sander has a one-piece generally solid body containing a means for removably securing the sandpaper to the sander without piercing the sandpaper. Conduits contained within the sander body regulate the flow of water, or other suitable liquid, from an external pressurized source to a plurality of liquid outlets along both sides of the sander. The water then flows past the edges of the sandpaper strip and onto the surface being sanded. Edge strips are preferably added to direct the water when the surface being worked is vertical or near-vertical or overhanging.

15 Claims, 2 Drawing Sheets

WET SANDER

TECHNICAL FIELD

The present invention relates to a manually operated abrasive tool. In particular, the present invention relates to a new and improved manual sander having a means for flowing liquid in a controlled manner from an external source through the sander and onto the surface being abraded.

BACKGROUND OF THE INVENTION

Wet sanders are useful in abrading and removing surface defects or smoothing a variety of non-porous or nonhydrophilic surfaces in preparation for finishing with a sealing and/or protecting finish such as paint. Such wet sanders are commonly used following automobile repairs to smooth and prepare the automobile body for refinishing and repainting.

Most wet sanders use electrical or hydraulic power means to move an attached abrasive article, such as an attached strip or circle of wet-or-dry sandpaper, across the surface to be finished. Typical of such powered sanders are the orbital wet sanders, such as those disclosed in U.S. Pat. Nos. 4,523,411 to Freerks, 4,102,084 to Bloomquist, and 4,175,359 to Teague, Jr. While these mechanized devices have their uses, they may be too large to operate in cramped spaces or to provide the very smooth final finish required before painting. Additionally, they tend to be quite expensive and, thus, not a practical alternative for the do-it-yourselfer.

Manual wet sanding can be performed by using a dry sanding block and periodically dipping the sandpaper into water or periodically pouring water onto the surface being worked. Unfortunately this is inconvenient and does not provide sufficient fluid to lubricate the surface continuously and remove the particles abraded away to prevent a build up of the abraded particles on the surface and on the sandpaper.

Another means for manual wet sanding is disclosed in U.S. Pat. No. 4,484,419 to Freerks which provides a hand sander containing a reservoir for liquid which could be wiped onto the working surface through an opening in the sandpaper attached to the bottom of the sander. The water is prevented from flowing onto the surface by a hydrophilic sponge which wipes the water over the surface. This approach has many problems. First, and most importantly, there is no flow of water over the surface to help flush the abraded particles away and provide a continuously changing film of lubricant on the working surface. Second, for a hand sander, the reservoir would be necessarily limited in size and would need to be filled periodically. Third, the sponge which prevents the flow of the water could become worn or clogged with abraded particles, and would thus need to be cleaned and adjusted periodically to make sure it continues to contact the working surface. Further, when the reservoir empties, the sponge would act to remove water from the surface being worked. Finally, special sandpaper would have to be used since it would have to have an opening to permit the sponge to pass through the sandpaper and contact the working surface. Such sandpaper would have a smaller abrasive area than sandpaper without the opening and would, thus, require more frequent changes.

Yet another approach to manual wet sanding was taken in U.S. Pat. No. 4,320,601 to Haney which discloses a manual sanding block which provides for a continuous flow of water to the working surface by flowing water from an external source through an inlet in the sanding block and out through a sharpened outlet which projects beyond one wall and penetrates the attached strip of sandpaper. Unfortunately, this only provides one outlet for water to flow onto the working surface and, by directing water out one side only does not insure that the sandpaper will pass across a fresh film of water with each stroke. This problem is overcome to some extent on a horizontal surface by the movement of the sanding block over the water flowed onto the surface, but would appear to be a significant problem when the sanding block is used on a surface that is vertical or near vertical and the orientation of the outlet is any direction other than "up". Further, because the sandpaper backing may become easier to tear or destroy as it becomes wet, an outlet which penetrates or otherwise affects the integrity of the sandpaper may serve as a source of tears which could render the sandpaper useless and require frequent replacement. Additionally, while a gentle flow of liquid is desirable, a high pressure stream of liquid is not. To prevent messy working conditions and an unnecessary waste of the liquid used, the flow rate of the liquid should be controlled or regulated. The '601 patent does this by including an adjustable valve on the sanding block to control the flow passing through the single outlet. However, valves can leak or become inoperative, and may not provide a proper flow in the hands of an unskilled worker.

Therefore, the need exists for a manually operated wet sander which can use standard strips or rolls of sandpaper, which removably secures the sandpaper in place by a method which does not penetrate or otherwise affect the integrity of the sandpaper, and which provides a controlled flow of water over surfaces ranging from horizontal to near-vertical.

SUMMARY OF THE INVENTION

An object of this invention is to provide a manually operated wet sander to which readily available standard strips or rolls of sandpaper can be removably attached without penetrating or otherwise affecting the integrity of the sandpaper.

A further object of this invention is to provide a manually operated wet sander which provides a controlled flow of water through the sander from an external source over horizontal to near vertical surfaces.

A further object of this invention is to provide a manually operated wet sander which can provide a relatively constant controlled flow of water when attached to a higher pressure external source of liquid such as a garden hose without the need for incorporating an independent mechanical valve or regulator.

Other objects of the invention will become readily apparent to those skilled in the art from the following description and the accompanying drawings.

DETAILED DESCRIPTION

The present invention provides an improved manually operated wet sander.

Figure 1:
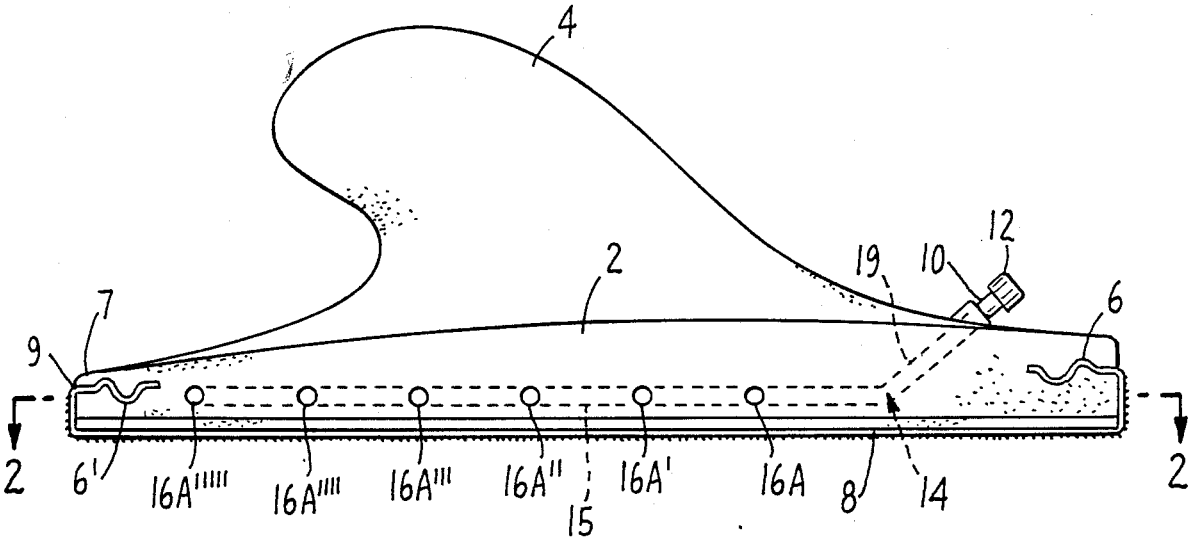
FIG. 1 is a sectional side view of a manually operated wet sander of the present invention.
Figure 2:
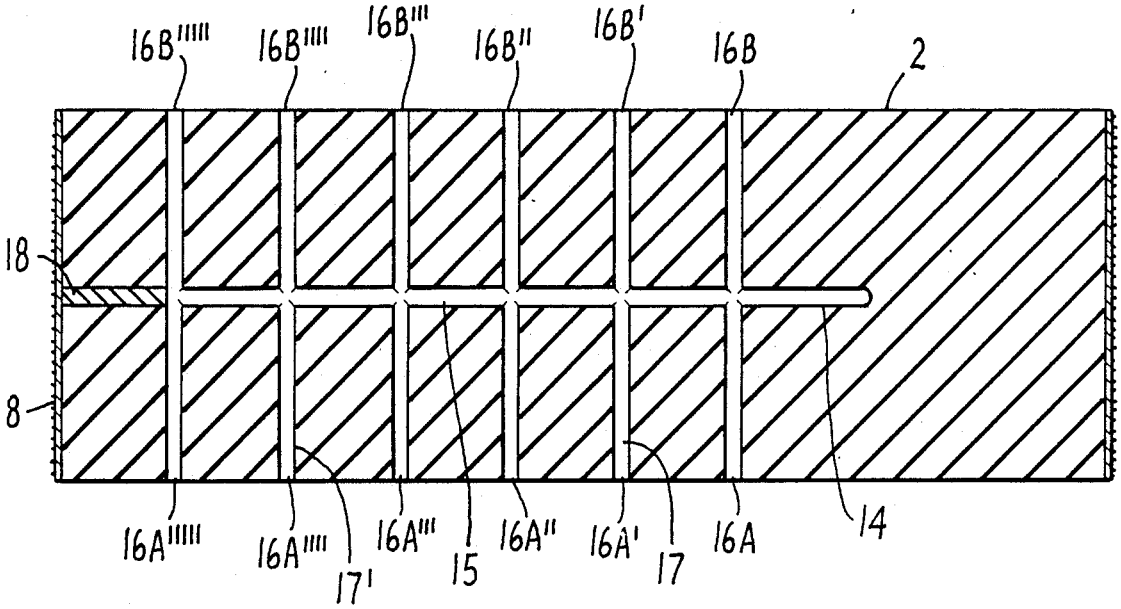
FIG. 2 is a cross-sectional view of the sander of FIG. 1 taken through line 2—2.
Figure 3:
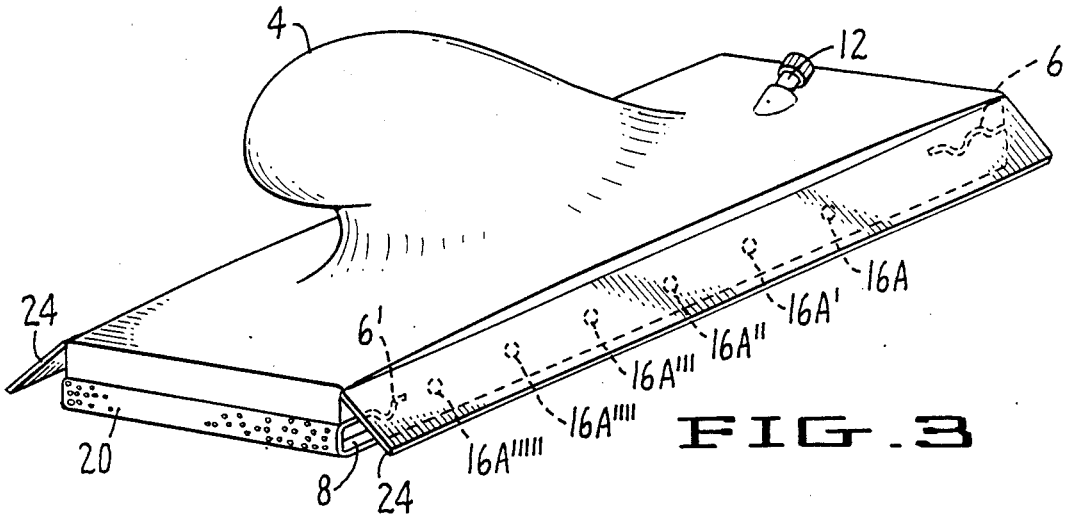
FIG. 3 is a perspective view of the sander of FIG. 1.

FIGS. 1 through 3 illustrate a typical manually operated sander of the present invention. The body 2 of the sander is preferably constructed from a solid, relatively stiff piece of rubber, although other suitable rigid materials, such as hard plastic, metal or wood may be used. A thin cushion 8, formed from a durable cushioning material such as a crepe rubber, may be attached, for example by using an adhesive, to provide a good frictional surface to prevent slippage of the backing of the sandpaper strip 20.

The sander preferably includes a contoured handle 4 for allowing the user to comfortably grasp and hold the sander. A means for holding the ends of a strip of sandpaper 20 is provided by jaws 6, 6' which are located at opposite ends of the sander. In the preferred embodiment, body 2 is molded from a hard rubber and jaws 6, 6' are molded in and designed with a series of steep ascending and descending curves or slopes capable of holding the sandpaper securely by means of friction. To replace a worn strip of sandpaper in this embodiment one merely needs to opens the jaws by pulling the upper jaw 7 from the lower jaw 9 and removing the ends of the worn sandpaper from between the jaws. A fresh strip of sandpaper is attached by lifting the upper jaw 7 up away from the lower jaw 9, inserting one end of the sandpaper strip between upper jaw 7 and lower jaw 9, and releasing the upper jaw 7 to allow the upper jaw 7 to return to its normal position down against lower jaw 9, thus securing the first end of the sandpaper strip. The sandpaper strip is then snugly stretched over the bottom surface of the sander and held tightly in place while the other end is inserted into the opposite set of jaws 6' in a similar fashion.

These integral jaws 6, 6' securely hold the ends of a strip of sandpaper frictionally, by forcing it to follow a non-planar series of steep curves or slopes. Alternatively, other methods of securing the sandpaper to the sander can be used, including for example, clips, mechanical jaws, and sandpaper having pressure-sensitive adhesive on one side for removably attaching the sandpaper to the bottom of the sander.

An inlet 10 for the introduction of a liquid from an external source is provided, preferably at the top surface of the sander. An adapter 12 is used to connect a hose between the external liquid source and the inlet 10. Liquid flowing from inlet 10 passes through conduit 14 and out through a plurality of outlets 16 A and B along the sides of the sander.

Inlet 10, multiple outlets 16A and 16B, and the conduit 14 connecting the inlet with the outlets may be molded into the body 2 of the sander at the time the sander is formed, or may be subsequently formed by drilling through the material used to construct the sander to form the conduit and outlets. Formation by drilling may be accomplished, for example, by drilling one long passageway 15 down the center of the sander; short passageways 17, 17' can be drilled transversely to long passageway 15, and will extend from one side of body 2 to the other side; a diagonal passageway 19 can be drilled from the top surface of body 2 to intersect long passageway 15; finally, the open end of long passageway 15 is sealed with plug 18. The preferred diameter of the conduit 14 and the outlets 16A and 16B is about one-eighth inch.

Figure 4:
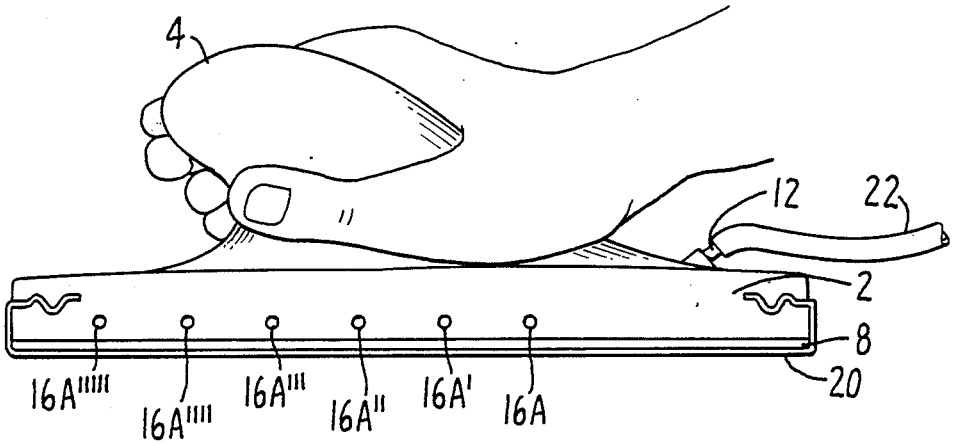
FIG. 4 is a side view of the sander of FIG. 1 attached to an external source of water for use.

The flow rate through the sander can be controlled without the need for mechanical regulators or valves by passing the water from a relatively high flow rate or otherwise pressurized external source through a small diameter conduit which limits the maximum flow rate. The maximum flow rate of any fluid through a smooth, rigid conduit of a specific length is a function of the inside diameter of the conduit and the viscosity of the fluid. Thus, for a fluid of specific viscosity passed through a conduit of a specific length, the maximum flow rate may generally be reduced by reducing the diameter of the conduit. Water is the liquid of choice for most wet sanding operations. The most convenient and commonly available external source of water for home sanding operations is found in the ubiquitous garden hose attached to a spigot. However, flow rates through such hoses cannot be accurately controlled using the spigot; generally the water is either "on" (maximum or near-maximum flow rate) or "off" (zero flow rate). The present invention controls the flow rate of water onto the surface being sanded by limiting the size of the inlet 10, conduit 14 and outlets 16 most preferably to about $\frac{1}{8}$ inches in diameter, although satisfactory results can be obtained when diameter range from about $\frac{1}{8}$ inches in diameter up to about $\frac{1}{4}$ inches in diameter. At the smaller end of the range of diameters, it would be possible to directly attach a garden hose, using an adapter, to the sander at connector 12. However, this would not preferable because the weight and stiffness of a garden hose at maximum flow, if attached directly to one end of the sander, could interfere with the use of the sander. To avoid this difficulty, a length of flexible hose 22 having an inside diameter ranging from about $\frac{1}{8}$ inches to about $\frac{1}{4}$ inches preferably is used as an interface between the sander and the garden hose. Hose 22, shown in FIG. 4, can be attached at one end to connector 12 and at the other end to the garden hose, using a suitable adapter. The length of hose 22 is variable, with a preferred length of from about 4 feet to about 8 feet for providing a good, relatively constant flow through the sander. If a liquid other than water is to be used for wet sanding, the diameter and length of hose 22, and the diameter of conduit 14, outlet 16, and inlet 10 can be increased or decreased for significant increases or decreases in the viscosity of the specific liquid to be used as compared to water.

Flaps 24 are preferably provided for directing the water onto the surface being sanded when the surface being sanded is near vertical or overhanging. Flaps 24 will eliminate to some extent the flow of water over the top of the sander when the sander is placed against a vertical or near vertical surface, and will direct most of the water against overhanging surfaces being sanded in which the sander is being used in an inverted position. Flaps 24 may be molded onto the sides of the sander at the time of manufacture or subsequently attached to the sides of the sander. Flaps 24 are preferably constructed of flexible rubber, similar to that used in windshield wiper blades. Alternatively, a rubber strip having small plugs spaced to cooperate with and plug the outlets along one side of the sander may be removably attached to prevent the loss of liquid from the down side of the sander when the sander is used on a vertical surface.

Figure 5:
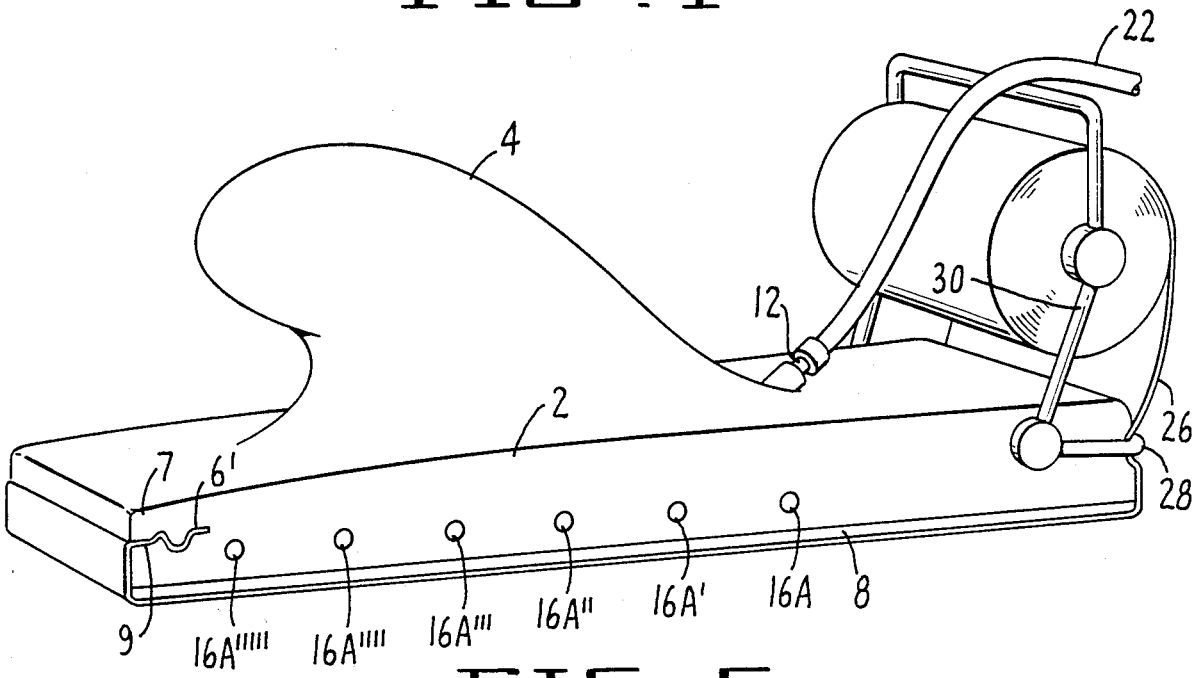
FIG. 5 is a side view of a manually operated wet sander of the present invention equipped to use a roll of sandpaper.

FIG. 5 illustrates an embodiment of the present invention in which a roll of sandpaper, rather than a sandpaper strip, is attached to the sander. In this embodiment, jaws 6' are located at the front of the sander and the roll of sandpaper 26 is attached to the back of the sander. Roll 26 is attached to bracket 30 such that the roll can be freely rotated to dispense sandpaper. Free rotation during the sanding operation is prevented by locking bar 28 which secures the sandpaper against the back of the sander. Replacement of a worn out length of sandpaper is thus simplified in this embodiment. The top jaw 7 is pulled up and the front end of the sandpaper removed from the jaws 6. The worn out length of sandpaper is torn away along the locking bar 28. Then, locking bar 28 is rotated downward, permitting movement of sandpaper from the roll 26. A fresh length of sandpaper is pulled from roll 26. Top jaw 7 is pulled up, the end of the fresh length of sandpaper is place in jaws 6, and top jaw 7 is released, trapping the end of the sandpaper in jaws 6. Roll 26 is rotated to tighten the sandpaper against the bottom of the sander, and locking bar 28 is rotated upward to hold the sandpaper tightly against the back end of the sander and to prevent the sanding operation from pulling sandpaper from the roll 26.

One skilled in the art will recognize at once that it would be possible to construct this invention from a variety of materials. While the preferred embodiment of the present invention has been described in detail and shown in the accompanying drawings, it will be evident that various modifications are possible without departing from the scope of the invention.

I claim:

1. A manually operated wet sander having a top surface, a bottom surface, a front, a back, and two sides, comprising:

a gripping means by which a user can hold sand sander when said sander is in use;

a means for securing a strip of sandpaper to the bottom surface of said sander, which means securely holds without penetrating said sandpaper along the bottom, front or back of said sander, and without compressing or distorting said gripping means;

a means for directing a flow of fluid from an external, pressurized fluid source through said sander to a plurality of outlets along the two sides of the sander and out to a surface being sanded, said outlets not penetrating said sandpaper, and said means for directing a flow being adapted to reduce the pressure of the fluid to permit the fluid to provide a substantially constant flow of fluid from the sander onto the surface being sanded.

2. The sander of claim 1 in which said gripping means is a contoured handle molded to fit a user's hand and projects upward from the top surface of said sander such that said sander may be grasped by a user with only a user's smallest finger touching said top surface and with a user's remaining fingers aligned along said handle above the top surface of said sander.

3. The sander of claim 1 in which said means for securing sandpaper comprises a pair of jaws having a plurality of steep, nonpolar curves molded in the front and back of said sander.

4. The sander of claim 3 in which said means for securing sandpaper additionally comprises a means for holding a roll of sandpaper attached to either the front or the back of said sander.

5. The sander of claim 1 in which said means for directing a flow of fluid from said external source through said sander additionally comprises a fluid inlet, and a conduit passing through the interior of said sander from said water inlet to each said water outlet, said inlet, said outlets and said conduit having a diameter of from about $\frac{1}{8}$ inch to about $\frac{1}{4}$ inch.

6. The sander of claim 5 in which said sander is molded from a hard rubber or plastic material.

7. The sander of claim 5 in which said fluid inlet additionally comprises a connector means for connecting a hose having a diameter of about $\frac{1}{8}$ inch to about $\frac{1}{4}$ inch between an external pressurized fluid source and said sander for controlling the flow of fluid through said sander.

8. The sander of claim 1 additionally comprising a means along each side of the sander for directing the flow of liquid from outlets along that side to the surface being sanded.

9. The sander of claim 8 wherein the means for directing the flow of liquid from outlets comprises a flexible rubber flap having a top edge and a bottom edge, said flap being attached along its top edge to the top surface of the sander and being of such a size that said flap extends along approximately the entire length of each side and such that said bottom edge extends substantially to the surface being sanded.

10. A manually operated wet sander adapted for use with a garden hose, said sander having a top surface, a bottom surface, a front, a back, and two sides, said sander adapted to hold a strip of sandpaper comprising:

a contoured handle molded to fit a user's hand and extending upwardly from the top surface so that only a user's smallest finger is positioned to contact the top surface when the sander is gripped;

a means for securing said strip of sandpaper to the bottom surface of said sander without penetrating said sandpaper and without compressing or distorting said handle;

a means for directing a relatively high pressure stream of fluid from said garden hose through said sander, said means essentially including a fluid inlet, a plurality of outlets along the two sides of the sander which do not penetrate said sandpaper, and a conduit passing through the interior of said sander from said fluid inlet to each said outlet, said inlet, said outlets and said conduit having a diameter of from about $\frac{1}{8}$ inch to about $\frac{1}{4}$ inch for reducing the pressure of the fluid stream to provide a substantially constant, low pressure flow of fluid from the sander onto the surface being sanded, said means not including a valve.

11. The sander of claim 10 in which said means for securing sandpaper comprises a pair of integral jaws having a plurality of steep, nonplanar curves molded in the front and back of said sander for frictionally holding said sandpaper.

12. The sander of claim 10 additionally comprising a means for securing a roll of sandpaper attached to either the front or the back of the sander.

13. The sander of claim 10 in which said garden hose is attached to a first end of a second hose, said second hose having said first end, a second end, and a diameter of about $\frac{1}{8}$ inch to about $\frac{1}{4}$ inch, said fluid inlet additionally comprising a connector means for attaching said second end of said second hose to said fluid inlet.

14. The sander of claim 10 additionally comprising a means attached to at least one side of the sander for directing the flow of liquid from the outlets along that side to the surface being sanded.

15. The sander of claim 14 in which said means for directing the flow of liquid from the outlets to the surface being sanded comprises a flexible rubber flap, said rubber flap having a first edge attached to said side, a second edge extending substantially to the surface being sanded, and said rubber flap being of sufficient size to extend along substantially the entire length of said side.

* * * * *